US008752820B2

(12) United States Patent
Nishiyama

(10) Patent No.: US 8,752,820 B2
(45) Date of Patent: Jun. 17, 2014

(54) ENVELOPE WARPAGE CORRECTING DEVICE

(75) Inventor: Akira Nishiyama, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/361,493

(22) Filed: Jan. 30, 2012

(65) Prior Publication Data

US 2012/0202672 A1 Aug. 9, 2012

(30) Foreign Application Priority Data

Feb. 4, 2011 (JP) ..... P2011-022423

(51) Int. Cl.
*B65H 5/00* (2006.01)

(52) U.S. Cl.
USPC ..... 271/2; 271/274; 399/406

(58) Field of Classification Search
USPC ..... 271/2, 273, 274, 1; 399/406
See application file for complete search history.

(56) References Cited

U.S. PATENT DOCUMENTS

| | | | | | |
|---|---|---|---|---|---|
| 5,481,348 | A * | 1/1996 | Mihara et al. | ..... | 399/405 |
| 5,640,664 | A * | 6/1997 | Ukei et al. | ..... | 399/393 |
| 5,787,331 | A * | 7/1998 | Ohkuma et al. | ..... | 399/406 |
| 5,848,347 | A * | 12/1998 | Kuo et al. | ..... | 399/406 |
| 6,036,185 | A * | 3/2000 | Baumann et al. | ..... | 271/2 |
| 6,259,888 | B1 * | 7/2001 | Kazama et al. | ..... | 399/406 |
| 6,648,328 | B2 * | 11/2003 | Sugimoto | ..... | 271/273 |
| 7,347,420 | B2 * | 3/2008 | Kobayashi et al. | ..... | 271/272 |
| 7,383,017 | B2 * | 6/2008 | Ushio | ..... | 399/406 |

FOREIGN PATENT DOCUMENTS

JP 2001-162917 A 6/2001

* cited by examiner

*Primary Examiner* — Ernesto Suarez
(74) *Attorney, Agent, or Firm* — Nath, Goldberg & Meyer; Jerald L. Meyer

(57) ABSTRACT

An envelope warpage correcting device includes a sheet feeding portion, a correction means and a control portion. The sheet feeding portion feeds envelopes one-by-one in a state where the envelopes are stacked on a sheet feed table and a rear end portion opposite to a flap portion formed in a front end portion of each of the envelopes is set to a leading portion in a sheet feed direction. The correction means corrects warpage occurring at a side of the rear end portion of the envelope fed by the sheet feeding portion. The control portion controls processing for correcting the warpage occurring at the side of the rear end portion by the correcting portion at certain timing according to an attribution of the envelope.

3 Claims, 10 Drawing Sheets

ENVELOPE WARPAGE CORRECTING DEVICE

CROSS REFERENCE TO RELATED APPLICATION

This application claims benefit of priority under 35 U.S.C. §119 to Japanese Patent Application No. 2011-022423, filed on Feb. 4, 2011, the entire contents of which are incorporated by reference herein.

BACKGROUND OF THE INVENTION

1. Field of the Invention

The present invention relates to an envelope warpage correcting device that is applicable to a printer printing an image on an envelope or a sheet such as plain paper, heavy paper, thin paper or mat paper, and is capable of correcting warpage (bending) occurring at a side of a rear end portion of each envelope when envelopes are stacked on a sheet feed table in a state of setting the rear end portion opposite to a flap portion formed in a front end portion of each envelope to a leading portion of envelope in a sheet feed direction.

2. Description of the Related Art

Generally, as a printer (image forming apparatus) for household use or business use that prints (forms) an image on an envelope or a sheet such as plain paper, heavy paper, thin paper or mat paper, an ink-jet printer, a stencil printer, a laser beam printer, a thermal transfer printer and the like have been frequently used.

In this type of printer, there is an envelope feeding apparatus that prevents a hard corner portion of envelope from damaging a master on a plate cylinder mounted in the stencil printer (e.g., Patent document 1: Japanese Published Unexamined Patent Application No. 2001-162917).

In the envelope feeding apparatus disclosed in Patent document 1, envelopes stacked on an envelope placement table are fed to a carrier line one-by-one. A pressing mechanism mounted in the carrier line flattens each of hard corner portions of envelope fed from the envelope placement table. Thereby, the envelope feeding apparatus prevents each hard corner portion of envelope from damaging a master on a plate cylinder at a time of feeding the envelope to the plate cylinder.

As shown in FIG. 1, an envelope S applied to the envelope feeding apparatus disclosed in Patent document 1 is formed into a pocket-like shape by overlapping a top sheet and a back sheet thereof. The envelope S has flap portions Sb extending from both side of the top sheet. The flap portions Sb are used to seal the envelope S after a card, a letter or the like is enclosed in the envelope S. When the flap portions Sb are folded toward a side of the back sheet to seal the envelope S, each of the flap portions Sb overlaps with the top sheet and the back sheet. This thickens the four corner portions Sa of the envelope S. Theses corner portions Sa are pressed by the pressing mechanism, which prevents them from damaging the master on the plate cylinder. However, the envelope feeding apparatus does not have any preparation for warpage occurring in the envelope.

As shown in FIGS. 2A and 2B, a rectangular envelope F in which a letter or the like is enclosed is formed into a pocket-like shape by overlapping a top sheet Fa and a back sheet Fb of the envelope F. The envelope F has a flap portion Fd which extends from the top sheet Fa at a side of a front end portion Fc, and a tab for sticking Ff which extends from the top sheet Fa at a side of a rear end portion Fe and is folded and stuck to a side of the back sheet Fb. This thickens the side of the rear end portion Fe of the envelope F because the side of the rear end portion Fe has the total of thicknesses of three sheets although the flap portion Fd has the thickness of one sheet.

Therefore, as shown in FIGS. 3A and 3B, when rectangular envelopes F are stacked on a sheet feed table K in a state where a top sheet Fa of each envelope F faces up, the thickness of envelopes F at a rear end portion side is remarkably larger than the thickness of envelops F at a front end portion side as the number of envelopes F stacked on the sheet feed table K increases. Due to this, warpage (bending-upward) in an upper direction occurs at a side of a rear end portion Fe of each envelope F.

A degree of warpage occurring at a side of a rear end portion Fe of an envelope F depends on an attribution of the envelope F. An attribution of envelope F is defined by the following parameter: a length of envelope F in a longitudinal direction, a width of envelope F perpendicular to the longitudinal direction, a thickness of envelope F, a material or the like.

In a case where a printer prints (forms) an image on an envelop F, envelopes F are generally stacked on a sheet feed table K in a state where a top sheet Fa of each envelope F faces up, in order to print a name and an address on the top sheet Fa of each envelope F. At this time, since rigidity at a rear end portion Fe is higher than rigidity at a flap portion Fd formed at a side of a front end portion Fc of each envelope F, the rear end portion Fe is set to a leading portion of the envelope F in a sheet feeding direction, and the flap portion Fd faces a direction opposite to the sheet feeding direction while not being folded.

In a state where a rear end portion Fe of each of envelopes F stacked on a sheet feed table K is set to a leading portion of the envelope F, the envelopes F are fed to a carrier line one-by-one and then carried toward an ink-jet head mounted in an ink-jet printer (not shown). If warpage (bending-upward) in an upper direction occurs at a side of a rear end portion Fe of each envelope F, there is a possibility that the rear end portion Fe collides against the ink-jet head to damage the ink-jet head because a space between the carrier line and the ink-jet head is narrow.

In order to solve the above-described technical problem, if an envelope F composed of double sheets (a top sheet Fa and a back sheet Fb) is subjected to correction processing to correct the warpage, the top sheet Fa and the back sheet Fb at the side of the rear end portion Fe of the envelope F are subjected to correction processing in an integrated manner for the initial period of time. However, when the top sheet Fa and the back sheet Fb at the side of the front end portion Fc of the envelope F are subjected to correction processing, highly-load is applied to one surface side. This raises a problem that wrinkles occur on the top sheet Fa only at the side of the front sheet Fc. This occurrence of wrinkles on the top sheet Fa only at the side of the front sheet Fc is a unique problem for envelope. A general-use card does not have this problem.

It is noted that in a case where warpage (bending-downward) in a down direction occurs at a side of a rear end portion Fe of the envelope F, there is not any possibility that the rear end portion Fe damage the ink-jet head because the rear end portion Fe does not collide against the ink-jet head.

SUMMARY OF THE INVENTION

The present invention has an object to provide an envelope warpage correcting apparatus to be applied to a printer that prints an image on an envelope or a sheet, which can correct warpage occurring at a side of a rear end portion of the envelope at a time of stacking on a sheet feed table envelopes each of which a rear end portion opposite to a flap portion formed on a front end portion is set to a leasing portion, and can prevent wrinkles from occurring at a side of a front end portion of the envelope.

In order to solve the above-described conventional technical problem, the present invention provides an envelope warpage correcting device comprising: a sheet feeding portion that feeds envelopes one-by-one using a sheet feed roller in a state where the envelopes are stacked on a sheet feed table and a first end portion opposite to a flap portion formed in a second end portion of each of the envelopes is set to a leading portion in a sheet feed direction; a correcting portion that is arranged in a downstream direction with respect to the sheet feeding portion and corrects warpage occurring at a side of the first end portion of the envelope fed by the sheet feeding portion; and a control portion that controls processing for correcting the warpage occurring at the side of the first end portion of the envelope by the correcting portion at certain timing according to an attribution of the envelope.

According to this aspect of the present invention, since the control portion controls processing for correcting the warpage occurring at the side of the first end portion of the envelope by the correcting portion at certain timing according to an attribution of the envelope, the envelope warpage correcting device can correct the warpage occurring at the side of the first end portion of the envelope according to the attribution of the envelope and prevent wrinkles from occurring at the side of the second end portion of the envelope.

In a preferred embodiment of the present invention, the correcting portion includes a correction roller and a pressing mechanism, and the control portion controls the pressing mechanism at the certain timing to reduce pressing force of the correction roller to the envelope according to the attribution of the envelope.

According to this aspect of the preferred embodiment, the envelope warpage correcting device can correct the warpage occurring at the side of the first end portion of the envelope according to the attribution of the envelope and prevent wrinkles from occurring at the side of the second end portion of the envelope.

In a preferred embodiment of the present invention, the control portion controls the pressing mechanism such that the correction roller approaches the envelope to press the side of the first end portion of the envelope in a first direction opposite to a second direction in which the envelope warps before the correction, and separates from the envelope at the certain timing.

According to this aspect of the preferred embodiment, the envelope warpage correcting device can correct the warpage occurring at the side of the first end portion of the envelope according to the attribution of the envelope and prevent wrinkles from occurring at the side of the second end portion of the envelope.

In a preferred embodiment of the present invention, the control portion controls the pressing mechanism such that the correction roller presses the side of the first end portion of the envelope by relatively large pressing force in a first direction opposite to a second direction in which the envelope warps before the correction, and presses the side of the first end portion by relatively small pressing force in the first direction at the certain timing.

According to this aspect of the preferred embodiment, the envelope warpage correcting device can correct the warpage occurring at the side of the first end portion of the envelope according to the attribution of the envelope and prevent wrinkles from occurring at the side of the second end portion of the envelope.

In order to solve the above-described conventional technical problem, the present invention provides an envelope warpage correcting device comprising: a sheet feeding portion that feeds envelopes one-by-one using a sheet feed roller in a state where the envelopes are stacked on a sheet feed table and a first end portion opposite to a flap portion formed in a second end portion of each of the envelopes is set to a leading portion in a sheet feed direction; a correcting portion that is arranged in a downstream direction with respect to the sheet feeding portion and corrects warpage occurring at a side of the first end portion of the envelope fed by the sheet feeding portion; an envelope wrinkle detecting portion that is arranged between the sheet feeding portion and the correcting portion and detects wrinkles occurring at a side of the second end portion of the envelope at a time when the correcting portion corrects the warpage occurring at the side of the first end portion of the envelope; and a control portion that controls processing for correcting the warpage occurring at the side of the first end portion of the envelope by the correcting portion when the envelope wrinkle detecting portion detects wrinkles.

According to this aspect of the present invention, since the control portion controls processing for correcting the warpage occurring at the side of the first end portion of the envelope by the correcting portion when the envelope wrinkle detecting portion detects wrinkles, the envelope warpage correcting device can correct the warpage occurring at the side of the first end portion of the envelope according to the attribution of the envelope and prevent wrinkles from occurring at the side of the second end portion of the envelope.

DESCRIPTION OF THE EMBODIMENTS

Figure 1:
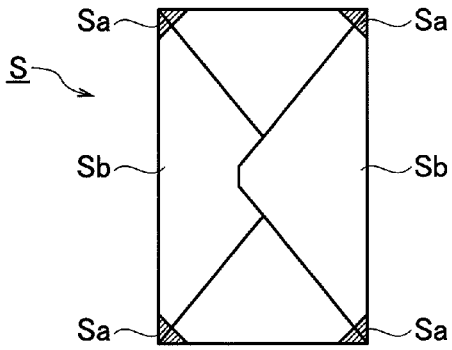
FIG. 1 is a diagram that illustrates an envelope disclosed in Patent document 1.
Figure 2A:
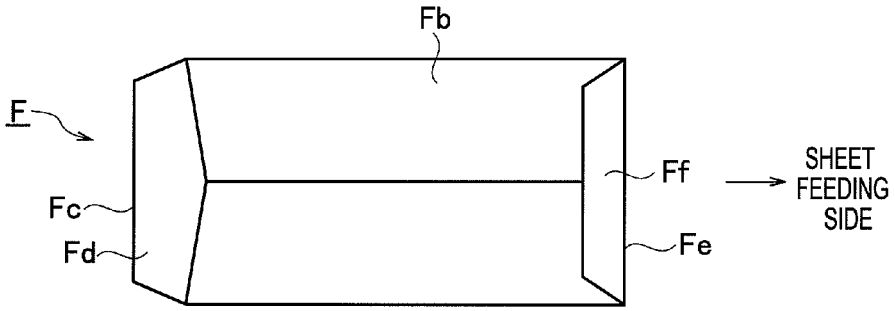
FIG. 2A is a diagram that illustrates a back side of rectangular envelope.
Figure 2B:
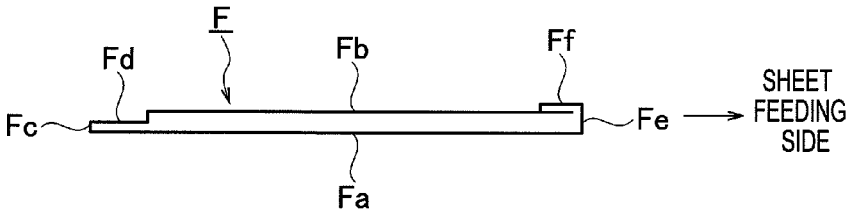
FIG. 2B is a diagram that illustrates a lateral side of rectangular envelope.

Envelope warpage correcting devices according to first and second exemplary embodiments of the present invention will be described below with reference to FIGS. 2 to 14.

An envelope warpage correcting device according to the present invention is configured to be applicable to a printer (image-forming apparatus) that prints (forms) an image on an envelope or a sheet such as pain paper, heavy paper, thin paper or mat paper. In the first and second exemplary embodiments, each envelope warpage correcting device is applied to an ink-jet printer whose a printing portion is provided with an ink-jet head, and corrects warpage occurring at a side of a rear end portion Fe opposite to a flap portion Fd formed in a front end portion Fc of the rectangular envelope F shown in FIG. 3A, and then prints an image on the envelope F using ink ejected from the ink-jet head, when envelopes are stacked on a sheet feed table.

(First Exemplary Embodiment)

A whole configuration of an envelope warpage correcting device 1A will be described with reference to FIG. 4.

The envelope warpage correcting device 1A uses an ink-jet printing method and includes an operation panel portion 10, a sheet feeding portion 20, a correction means (hereinafter, called an envelope warpage correcting portion) 30, a pair of resist rollers 42, a belt platen portion 50, a printing portion (image-forming portion) 60, a sheet ejecting portion 70, a control portion 80 and an electric power supply portion 90.

The operation panel portion 10 operates the whole of envelope warpage correcting device 1A. The sheet feeding portion 20 feeds envelopes F stacked on a sheet feed table 21 one-by-one using a sheet feed roller 23. The envelope warpage correcting portion 30 includes a pair of correction rollers 31 and a pressing mechanism 33 that are arranged in a downstream direction on a carrier line with respect to the sheet feeding portion 20, and correct warpage occurring at the side of the rear end portion Fe of the envelope F fed by the sheet feeding portion 20. The pair of resist rollers 42 rolls to carry the envelope F toward a further downstream direction on the carrier line after the rear end portion Fe of the envelope F whose warpage has been corrected by the envelope warpage correcting portion 30 is abutted thereon to get the rear end portion Fe line up.

The belt platen portion 50 carries the envelope F which has been carried by the pair of resist rollers 42 toward the printing portion 60 and then a furthermore downstream direction on the carrier line with respect to the printing portion 60. The printing portion 60 is arranged above the belt platen portion 50, has one or more line type ink-jet heads 61 each of which ejects ink IK, and prints (forms) an image on the envelope F. The sheet ejecting portion 70 ejects the envelope F on which the image has been printed by the printing portion 60. The control portion 80 controls the whole of envelope warpage correcting device 1A. The electric power supply portion 90 supplies electric power to each portion.

Each portion of the envelope warpage correcting device 1A will be described below in detail. A boxed-shaped housing 2 gives an appearance of the envelope warpage correcting device 1A.

The operation panel portion 10 is arranged on a top surface 2*a* of the housing 2 and provided with an envelope print key, a sheet print key, a start key, a stop key, a numerical keypad for inputting numeric character, a print number set key for setting the number of prints, an alarm display for alarming a user at a time of occurrence of jam or various failures, a liquid crystal panel and the like (not shown in the drawings).

In the sheet feeding portion 20, the sheet feed table 21 on which envelopes F are stacked is moved up and down along an outside of a sheet feed table guide side plate 2*b* mounted on a left side surface lower portion of the housing 2, by a motor 22 with encoder.

A sheet (not shown) such as plain paper, heavy paper, thin paper or mat paper other than an envelope F may be stacked on the sheet feed table 21. The sheet feed table 21 is provided with a pair of side fences for restricting movement of an envelope F or a sheet in a width direction of the envelope F or the sheet, and a sheet detecting sensor for detecting whether or not an envelope F or a sheet is stacked thereon. Only one type of sheets or envelopes can be stacked on the sheet feed table 21 without mixing plural types of sheets or envelopes. In the present embodiment, plural envelopes are stacked on the sheet feed table 21.

When envelopes F are stacked on the sheet feed table 21, a top sheet Fa of the envelope F faces up and a rear end portion Fe with high rigidity is set to a leading portion of envelope in a sheet feed direction. In this state, the envelope F is carried toward the printing portion 60. A user selectively operates the envelope print key, the sheet print key or the like mounted on the operation panel portion 10 based on a type of envelopes F or sheets stacked on the sheet feed table 21.

The sheet feed roller 23 is rotatably mounted above the sheet feed table 21. When the sheet feed table 21 is moved up along the sheet feed table guide side plate 2*b* of the housing 2, the sheet feed roller 23 abuts on a top envelope F and feeds the top envelope F.

The top envelope F fed by the sheet feed roller 23 is sandwiched between a separating roller 24 and a friction plate 25 mounted in a downstream direction on the carrier line with respect to the sheet feed roller 23, and carried toward a downstream direction on the carrier line with respect to them. Even if the sheet feed roller 23 feeds several envelopes F, the separating roller 24 feeds the several envelopes F one-by-one while cooperating with the friction plate 25, which prevents the several envelopes F from being fed at a time.

The sheet feed roller 23 and the separating roller 24 are driven and rotated in an anticlockwise direction at a predetermined carrying speed by a motor 27 with encoder via a gear line 26. The top envelope F is carried at a certain carrying speed according to the predetermined carrying speed.

The envelope warpage correcting portion 30 which is an essential part in the present embodiment is arranged in a downstream direction on the carrier line with respect to the sheet feeding portion 20. The envelope warpage correcting portion 30 has a function of correcting warpage occurring at a side of a rear end portion Fe opposite to a flap portion Fd formed in a front end portion Fc of a rectangular envelope F (see FIG. 3) when envelopes F are stacked on the sheet feed table 21.

In the present embodiment, although the envelope warpage correcting portion 30 is arranged in an upstream direction on the carrier line with respect to the pair of resist rollers 42, the arrangement is not limited to it. Since it is only necessary to correct warpage occurring at a side of a rear end portion Fe of an envelope F before the envelope F fed by the sheet feeding portion 20 reaches the printing portion 60, the envelope warpage correcting portion 30 may be arranged in a downstream direction on the carrier line with respect to the pair of resist rollers 42. Further, the sheet feeding portion and the envelope warpage correcting portion may be arranged outside the housing 2. In this case, the envelope warpage correcting portion corrects the warpage outside the housing 2 before the envelope F fed by the sheet feeding portion reaches the printing portion 60.

The envelope warpage correcting portion 30 includes a pair of correction rollers 31 rotatably mounted and having a driving roller (hereinafter called metal roller) 31A and the driven roller (hereinafter called sponge roller) 31B. The metal roller 31A is made of metal material and has a small diameter. The sponge roller 31B is made of sponge material and has a large diameter larger than the metal roller 31A. The metal roller 31A (driving side) is driven and rotated in an anticlockwise direction at a predetermined carrying speed by a motor 32 with encoder. The sponge roller 31B (driven side) is pressed by the pressing mechanism 33 to abut on the metal roller 31A. The top envelope F fed by the sheet feeding portion 20 is sandwiched between the metal roller 31A and the sponge roller 31B and carried toward a downstream direction on the carrier line with respect to them, which corrects the warpage occurring at the side of the rear end portion Fe thereof.

In the present embodiment, although the envelope warpage correcting portion 30 includes the pair of correction rollers 31, the motor 32 with encoder and the pressing mechanism 33, the components are not limited to them. A correction roller which is not linked to a driving source is mounted such that the pressing mechanism moves the correction roller to or away from an envelope F on the carrier line (not shown), and warpage occurring at a side of a rear end portion Fe of the envelope F may be corrected by this correction roller.

The pair of resist rollers 42 is driven and rotated by a motor 43 with encoder at a side of a downstream direction on the carrier line with respect to the pair of correction rollers 31. Firstly, the rear end portion Fe of the envelope F whose warpage has been corrected by the pair of correction rollers 31 is abutted on the pair of resist rollers 42 stopped. When the sheet feed roller 23 and the separating roller 24 are further rotated during a predetermined period after a resist sensor 41 which is arranged at a side of an upstream direction on the carrier line with respect to the pair of resist rollers 42 detect the rear end portion Fe of the envelope F being fed, a predetermined amount of deflection T occurs in the rear end portion Fe of the envelope F at the side of the upstream direction on the carrier line, as indicated by a two-dot chain line in FIG. 4. Due to this deflection T, the rear end portion Fe is aligned with respect to the pair of resist rollers 42.

The resist sensor 41 is arranged at the side of the upstream direction and first top edge sensor 44 is arranged at a side of a downstream direction on the carrier line with respect to the pair of resist rollers 42. The resist sensor 41 detects a passing of envelope F using a light transmissive photosensor. The first top edge sensor 44 detects a passing of envelope F using a light transmissive photosensor and has a function for controlling a start of ejection of ink IK in each ink-jet head 61 mounted in the printing portion 60.

After an amount of deflection T occurring in the rear end portion Fe of the envelope F reaches the predetermined amount, the pair of resist rollers 42 is driven and rotated according to a carrying speed by the motor 43 with encoder.

In a downstream direction on the carrier line with respect to the first top edge sensor 44, a second top edge sensor 45, the belt platen portion 50 and the printing portion 60 opposite to the belt platen portion 50 are arranged.

Since the second top edge sensor 45 is arranged above the belt platen portion 50 and at a side of an upstream direction on the carrier line with respect to the printing portion 60, it uses a light reflective photosensor. The second top edge sensor 45 has a function for controlling a start of ejection of ink IK in each ink-jet head 61 mounted in the printing portion 60 in cooperation with the first top edge sensor 44 arranged at a side of an upstream direction on the carrier line with respect to the second top edge sensor 45.

Figure 5:
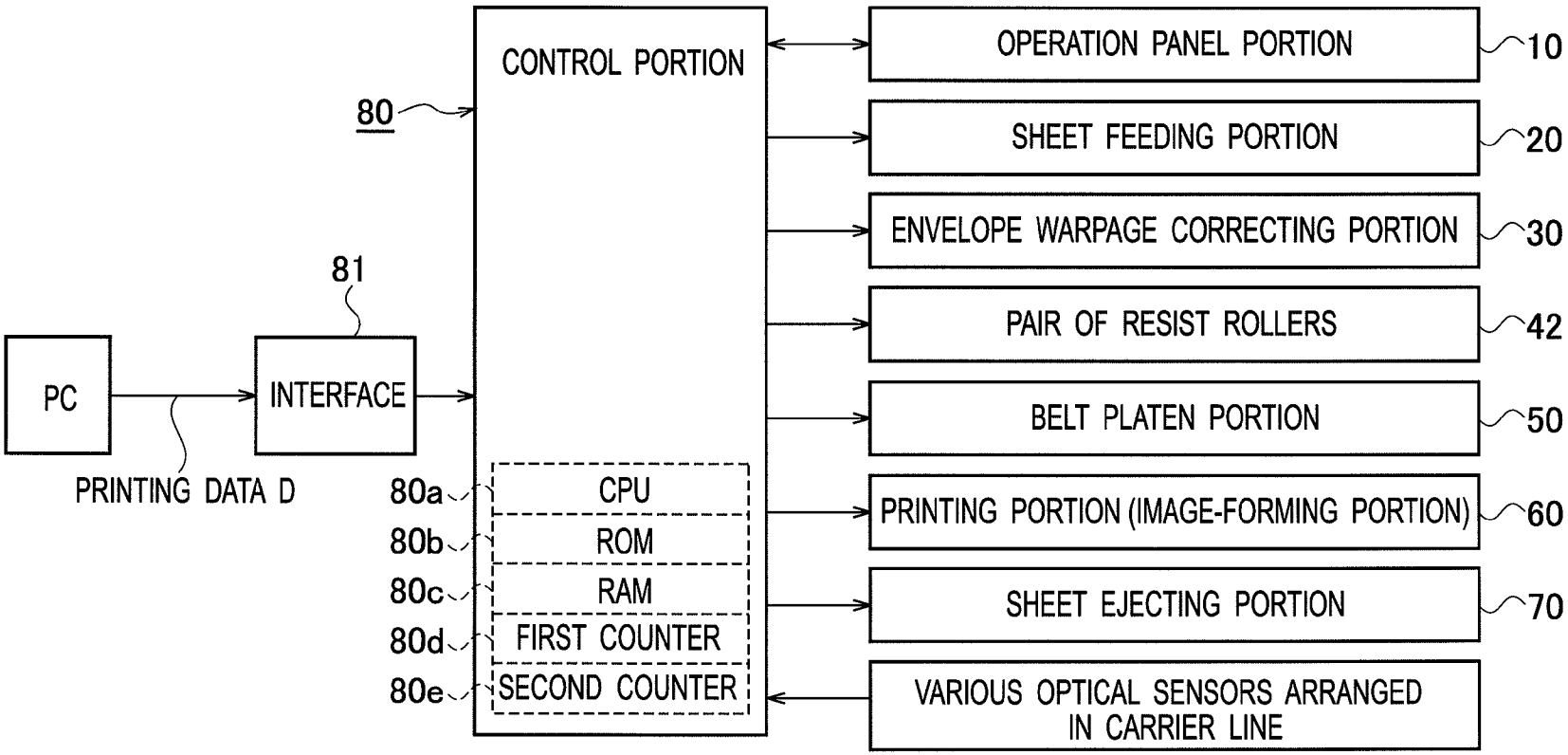
FIG. 5 is an enlarged diagram that illustrates a control portion shown in FIG. 4.

When the rear end portion Fe of the envelope F whose warpage has been corrected passes the first top edge sensor 44, the first counter 80*d* mounted in the control portion 80 starts to count the number of encoder pulses from a motor 54 with encoder mounted in the belt platen portion 50 (see FIG. 5). As well, when the rear end portion Fe of the envelope F whose warpage has bee corrected passes the second top edge sensor 45, the second counter 80*e* mounted in the control portion 80 starts to count the number of encoder pulses from the motor 54 with encoder. When the number of encoder pulses counted in the first or second top edge sensor 44 or 45 reaches the number of pulses previously set by each ink-jet head 61 for each color, the corresponding ink-jet head 61 stars to eject ink IK with corresponding color. The second top edge sensor 45 arranged in a downstream direction on the carrier line with respect to the first top edge sensor 44 mainly controls ink ejection. The first top edge sensor 44 has been prepared as a spare sensor to be used when the second top edge sensor 45 can not control ink ejection.

The reason why the second top edge sensor 45 is mainly used is as follows: (1) the second top edge sensor 45 is arranged above an endless belt platen 52 in the belt platen portion 50; (2) the second top edge sensor 45 is arranged in a position adjacent to the one or more ink-jet heads 61; and (3) the envelope F is sucked on the endless belt platen 52 to be carried at a certain carrying speed. Due to them, in comparison with detection by the first top edge sensor 44, the second top edge sensor 45 can obtain more accurate ink ejection timing at the time of detecting the rear end portion Fe of the envelope F.

Since the second top edge sensor 45 is arranged above the endless belt platen 52, it has to use a light reflective photosensor. In a case where a reflectance of the endless belt platen 52 is similar to a reflectance of an envelope F (or sheet) (e.g., when a black envelope F (or sheet) is carried on a black endless belt platen 52), there is a possibility that the second top edge sensor 45 can not detect the envelope F (or sheet). In this case, since the first top edge sensor 44 surely detects the envelope F (or sheet) using a light transmissive photosensor, the control portion 80 switches from the second top edge sensor 45 to the first top edge sensor 44.

The endless belt platen 52 with air vacuum holes (not shown) has a belt-like shape in a box body 51. The endless belt platen 52 is hung on a driven pulley 53, two intermediate pulleys 56 and a driving pulley 55 to be driven and rotated by a motor 54 with encoder at a certain carrying speed, and is endlessly rotated. In a state where hold-down rollers 57 and 58 approach the driven pulley 53 and the driving pulley 55, at least one envelope F fed on the endless belt platen 52 is carried toward the printing portion 60 and the sheet ejecting portion 70 while the at least one envelope F is air-suctioned in an air suction portion 59.

At this time, the belt platen portion 50 is mounted such that the box body 51 can be moved up or down by a moving up and down means (not shown) in order to adjust a clearance (gap) between the endless belt platen 52 and the one or more ink-jet heads 61 according to a size of an envelope F or a sheet. For example, the interval is set to a gap of 3.0 mm when the envelope print key mounted on the operation panel portion 10 is operated. The interval is set to a gap of 1.5 mm when the sheet print key is operated.

The printing portion 60 is mounted above the belt platen portion 50 such that it is slightly separated from the belt platen portion 50 and opposed to the belt platen portion 50. The printing portion 60 is located in the substantially center part in the housing 2.

In the printing portion 60, for example, an ink-jet head 61 for cyan ink IK (C), an ink-jet head 61 for black ink IK (K), an ink-jet head 61 for magenta ink IK (M) and an ink-jet head 61 for yellow ink IK (Y) are arranged in sequence from an upstream direction to a downstream direction on the carrier line. Each of three hold-down rollers 62 is mounted between adjacent ink-jet heads to press an envelope F on the endless belt platen 52.

In the present embodiment, although four ink-jet heads 61 corresponding to four color inks IK (CKMY) are arranged, the number of ink-jet heads is not limited to four. In a case of printing only characters, only one ink-jet head 61 corresponding to one color ink IK needs to be arranged. Therefore, it is necessary to arrange one or more ink-jet heads 61 in the printing portion 60.

Figure 4:
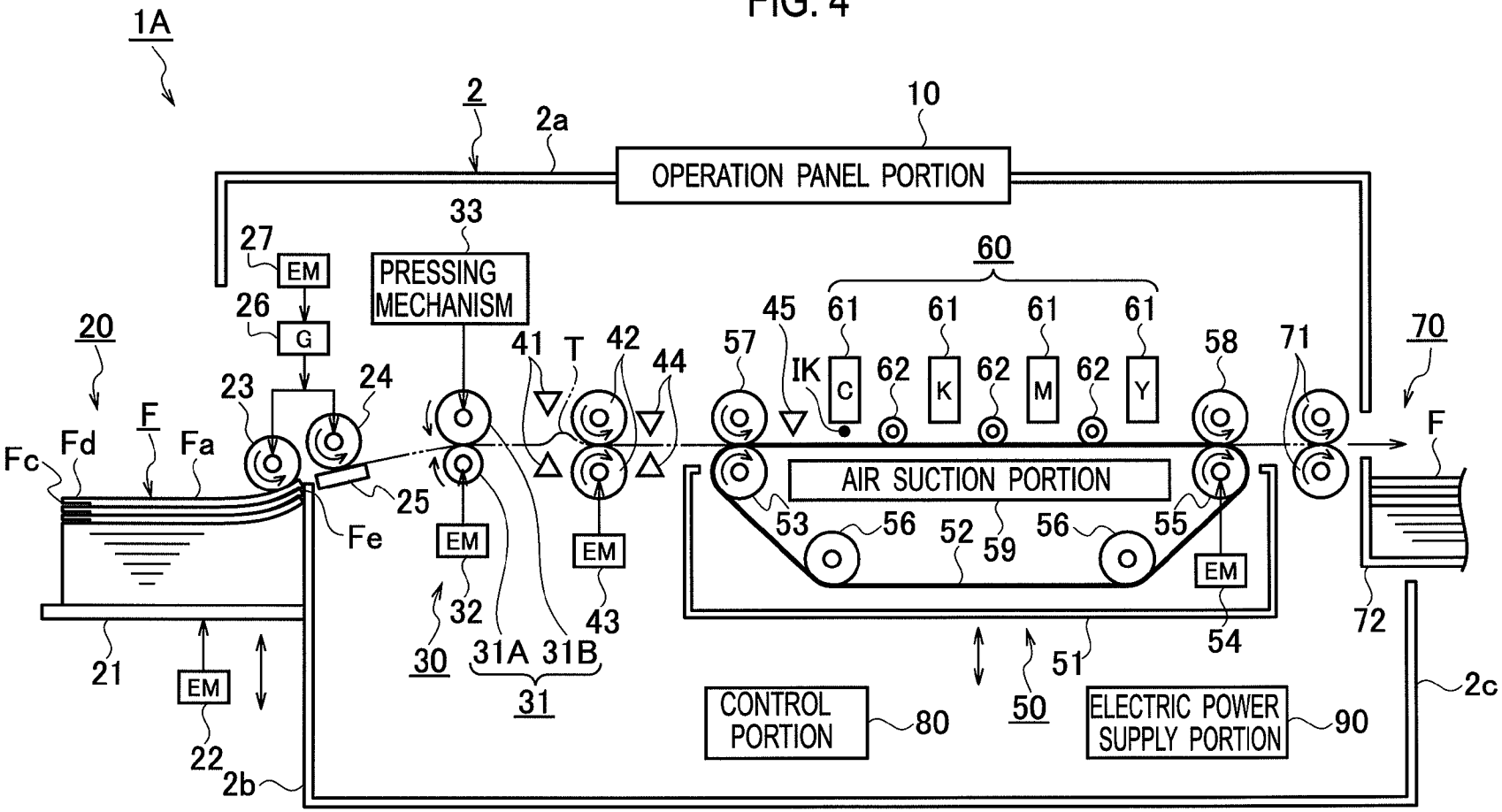
FIG. 4 is a whole configuration diagram that illustrates an envelope warpage correcting device according to a first exemplary embodiment of the present invention.

In each ink-jet head 61, each head block includes therein nozzles arranged in a main scanning direction perpendicular to a cross-section of the envelop warpage correcting device 1A shown in FIG. 4. Head blocks are arranged in one line in the main scanning direction. Lines are parallel to one another in a vertical scanning direction perpendicular to the main scanning direction. Head blocks are arranged in zigzag alignment across the lines in the vertical scanning direction such that adjacent head blocks partly overlap as viewed from the vertical scanning direction.

In a state where the envelope F is held on the endless belt platen 52 by air-suction, while the envelope F is carried by a rotation of the endless belt platen 52 in the vertical scanning direction (an arrow direction in FIG. 4), a color image is printed on the envelope F based on printing data D (see FIG. 5) by four ink-jet heads 61.

The sheet ejecting portion 70 is arranged in a downstream direction on the carrier line with respect to the belt platen portion 50 and the printing portion 60. The sheet ejecting portion 70 ejects the envelop F which has been printed in the printing portion 60, on a sheet ejection tray 72 which is detachably mounted on a side of a right side face 2*c* of the housing 2, via a pair of sheet ejection rollers 71.

As shown in FIG. 5, the control portion 80 includes a CPU 80*a*, a ROM 80*b*, a RAM 80*c*, the first counter 80*d* and the second counter 80*e*. The CPU 80*a* controls respective portions. The ROM 80*c* previously stores permanent information such as an operation program of the envelope warpage correcting device 1A. The RAM 80*c* temporary stores variable information at a time of operating the envelope warpage correcting device 1A. The first counter 80*d* counts the number of encoder pulses from the motor 54 with encoder (see FIG. 4) which is mounted in the belt platen portion 50 to control a start of ejection of ink IK in each ink-jet head 61 when an envelope F fed from the sheet feeding portion 20 passes the first top edge sensor 44. The second counter 80*e* counts the number of encoder pulses from the motor 54 with encoder (see FIG. 4) which is mounted in the belt platen portion 50 to control a start of ejection of ink IK in each ink-jet head 61 when an envelope F fed from the sheet feeding portion 20 passes the second top edge sensor 45.

Print date D created by a personal computer (PC) or the like is input into the control portion 80 via an interface 81. The control portion 80 controls the operation panel portion 10, the sheet feeding portion 20 including the sheet feed table 21, the sheet feed roller 23 and the separating roller 24, the envelope warpage correcting portion 30 including the pair of correction rollers 31 and the pressing mechanism 33, the pair of resist rollers 42, the belt platen portion 50, the printing portion (image-forming portion) 60 using the ink-jet printing method, the sheet ejecting portion 70 including the pair of sheet ejection rollers 71, and the optical sensors 41, 44 and 45 arranged in the carrier line.

Next, concrete structure and operation of the envelope warpage correcting portion 30 in the envelope warpage correcting device 1A will be described with reference to FIGS. 6A to 8B.

Figure 3A:
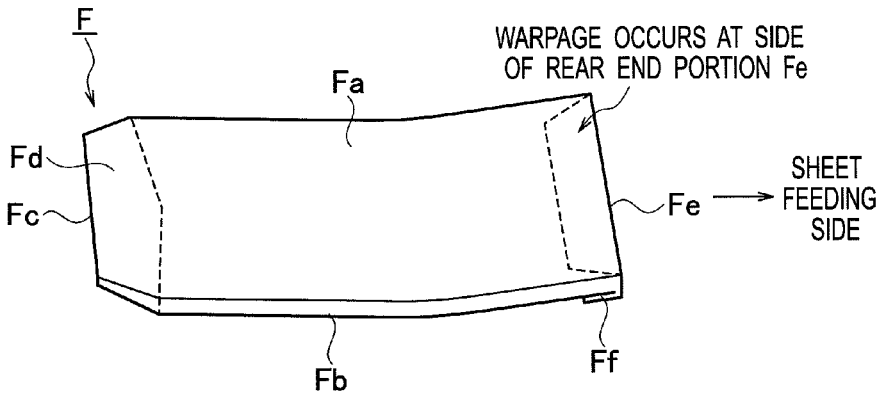
FIG. 3A is a perspective diagram that illustrates a top side of rectangular envelope in a state where warpage occurs at a side of a rear end portion of each envelope when rectangular envelopes are stacked on a sheet feed table.
Figure 3B:
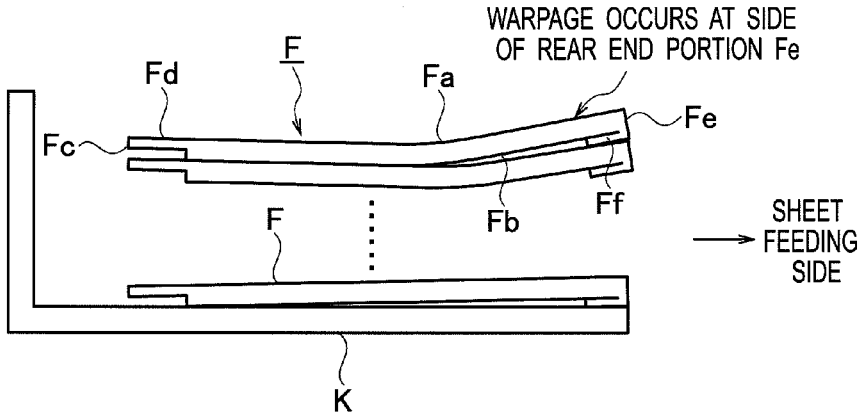
FIG. 3B is a diagram that illustrates a lateral side of rectangular envelopes in a state where warpage occurs at a side of a rear end portion of each envelope when the envelopes are stacked on a sheet feed table.
Figure 6A:
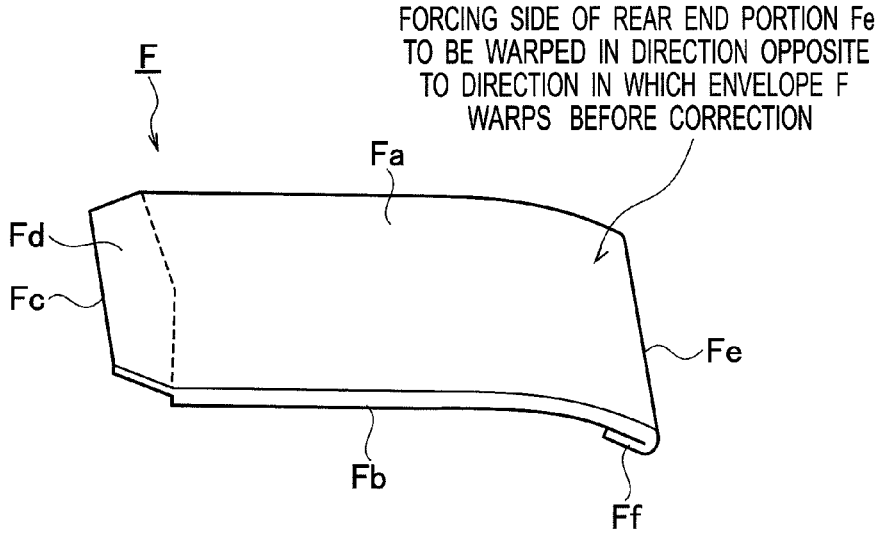
FIG. 6A is a perspective diagram that illustrates a state of warping an envelope before a correction in an opposite direction by sandwiching the envelope between a pair of correction rollers and carrying it so as to correct the warpage of envelope, according to the first exemplary embodiment of the present invention.

In order to correct warpage (bending-upward) occurring at the side of the rear end portion Fe of the envelope F shown in FIG. 3, the envelope warpage correcting portion 30 sandwiches the envelope F between the metal roller 31A and the sponge roller 31B forming the pair of correction rollers 31 and carries it. As shown in FIG. 6A, this warps the rear end portion Fe of the envelope F in an opposite direction such that the rear end portion Fe of the envelope F is warped in a direction opposite to a direction in which the rear end portion Fe of the envelope F warps before the correction. Namely, the envelope warpage correcting portion 30 forces the rear end portion Fe of the envelope F to be warped in a downward direction (bending-downward). This means that the bending-downward state shown in FIG. 6A is overlapped with the bending-upward state shown in FIG. 3A to cancel the both warpages. Thereby, the rear end portion Fe of the envelope F becomes flat.

Figure 6B:
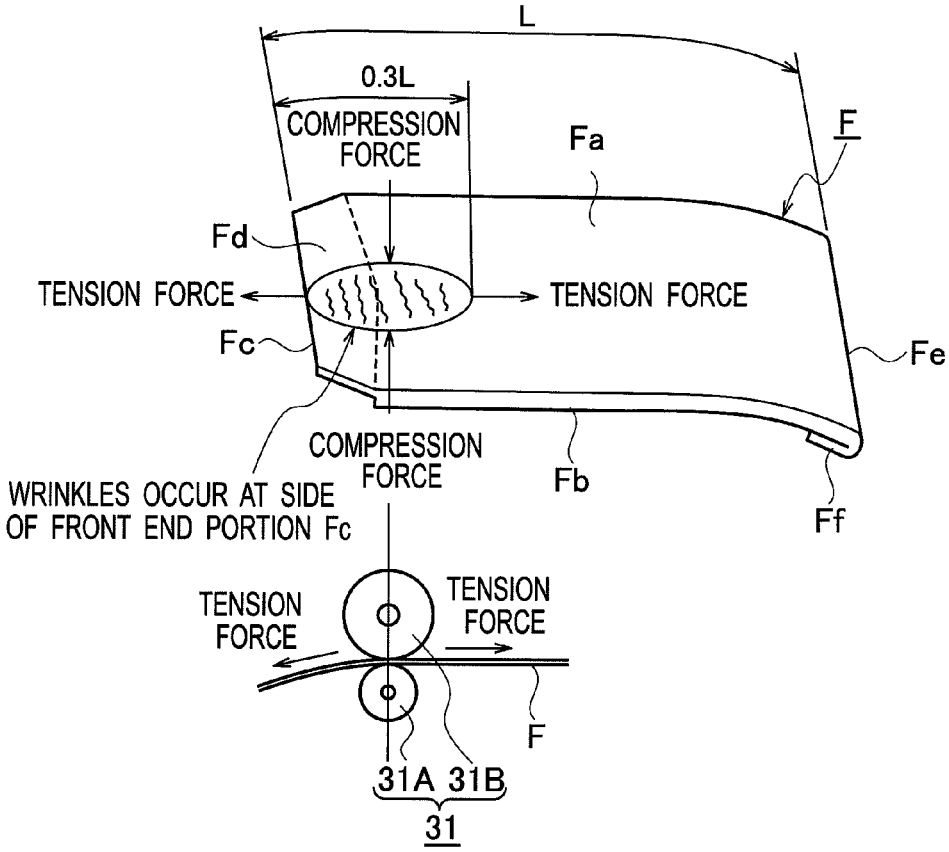
FIG. 6B is a perspective diagram that illustrates a state where wrinkles occur at a side of a front end portion of an envelope when the pair of correction rollers presses the entire area of the envelope according to the first exemplary embodiment of the present invention.

At this time, as shown in FIG. 6B, in the case where the rear end portion Fe of the envelope F is set to the leading portion of envelope in the sheet feed direction, when all parts of the carried envelope F are pressed by the pair of correction rollers 31 in order to obtain a strong correction effect, there is a possibility that wrinkles occur at the side of the front end portion Fc opposite to the rear end portion Fe along a longitudinal direction of the envelope F. Wrinkles extend from the center part of the envelope F in the width direction of the envelope F. The longer the entire length L of envelope F in the longitudinal direction is, the easier wrinkles are to occur. For example, wrinkles occur over a length (about 0.3 L) of about thirty percents of the entire length "L" at the front end portion Fc.

A reason why wrinkles occur will be described. When an envelope F is pressed between the metal roller 31A and the sponge roller 31B, tension force acts on the envelope F around a nip point on the envelope F in an upstream direction and a downstream direction on the carrier line. Due to this tension force, compression force occurs in a direction perpendicular to the upstream direction and the downstream direction on the carrier line. Due to this compression force, there is a possibility that wrinkles occur on the envelope F.

In order to resolve this problem, in the envelope warpage correcting portion 30, when the sponge roller (driven side) 31B is pressed toward the metal roller 31A (driving side) by the pressing mechanism 33 to sandwich an envelope F between the metal roller 31A and the sponge roller 31B, the pressing mechanism 33 can change pressing force according to a range for correcting warpage occurring at a side of a rear end portion Fe of the envelope F by an instruction from the control portion 80.

Figure 7A:
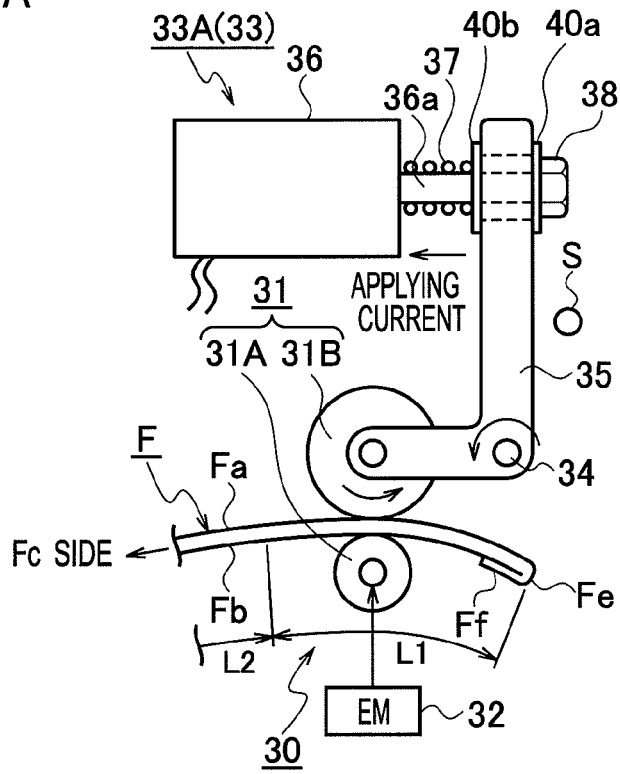
FIG. 7A is a diagram that illustrates a pressing mechanism in a first mode which a sponge roller of the pair of correction rollers approaches an envelope being fed by a metal roller of the pair of correction rollers in the envelope warpage correcting portion shown in FIG. 4.
Figure 7B:
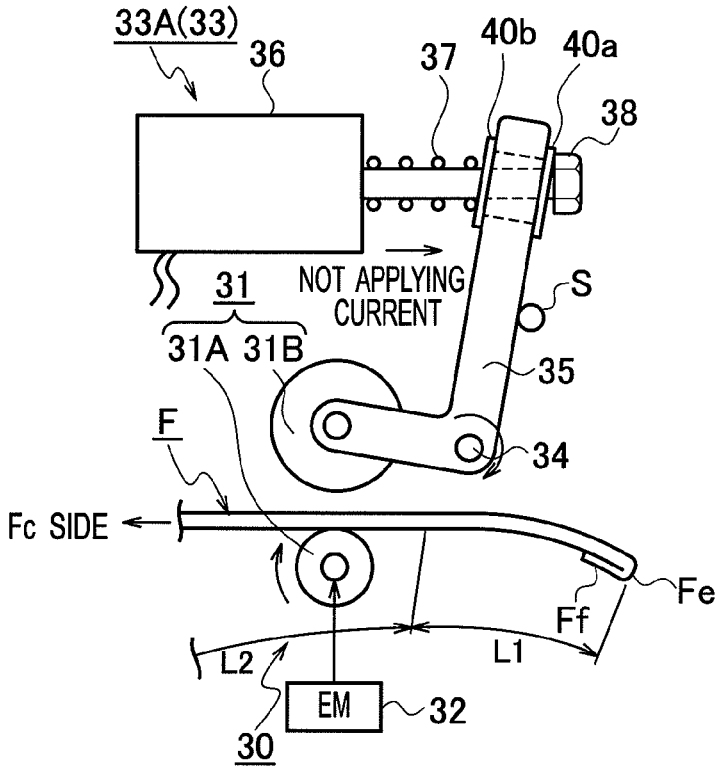
FIG. 7B is a diagram that illustrates the pressing mechanism in the first mode in which the sponge roller of the pair of correction rollers separates from an envelope being fed by the metal roller of the pair of correction rollers in the envelope warpage correcting portion shown in FIG. 4.
Figure 8A:
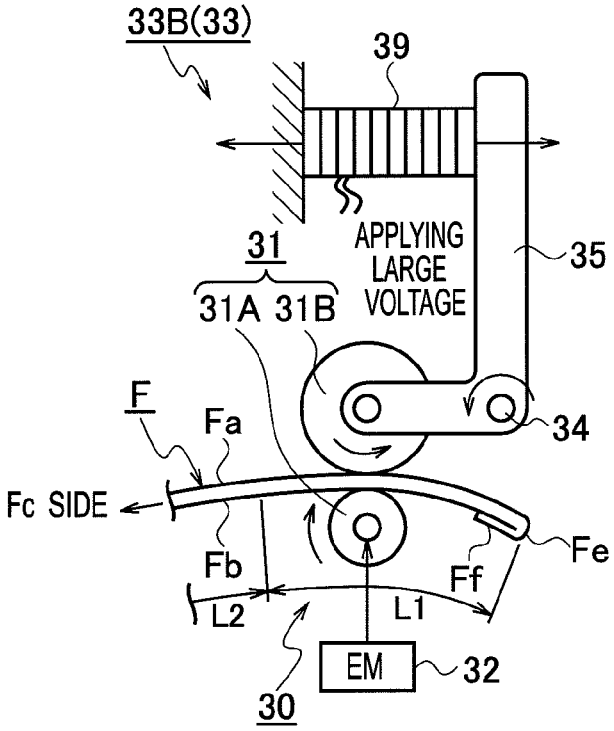
FIG. 8A is a diagram that illustrates a pressing mechanism in a second mode in which the sponge roller of the pair of correction rollers presses an envelope toward the metal roller of the pair of correction rollers in the envelope warpage correcting portion shown in FIG. 4.
Figure 8B:
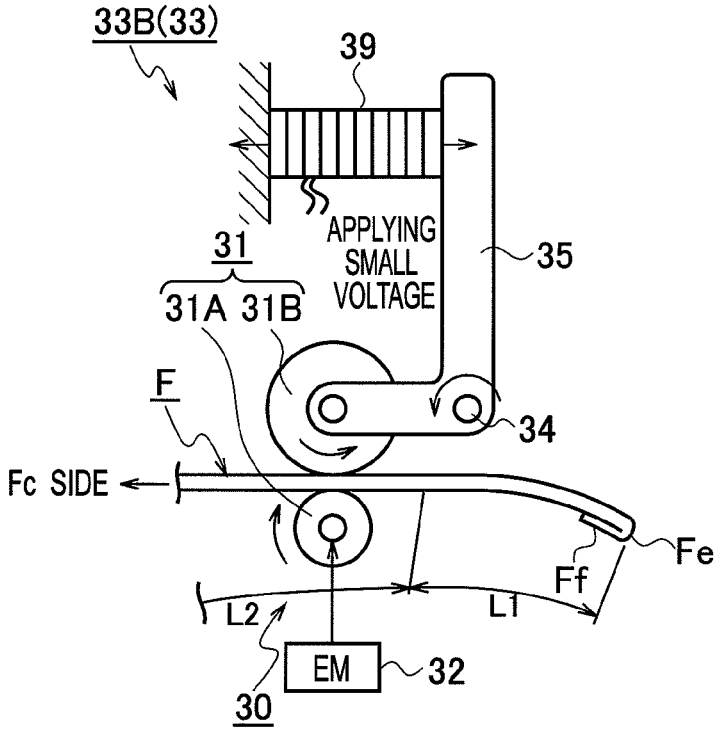
FIG. 8B is a diagram that illustrates the pressing mechanism in the second mode in which the sponge roller of the pair of correction rollers presses an envelope toward the metal roller of the pair of correction rollers in the envelope warpage correcting portion shown in FIG. 4.

When the pressing mechanism 33 controls pressing force by an instruction from the control portion 80, either a first mode shown in FIGS. 7A and 7B or a second mode shown in FIGS. 8A and 8B is applied to the pressing mechanism 33.

As shown in FIGS. 7A and 7B, in the first mode, the sponge roller 31B (driven side) is capable of approaching or separating from an envelope F being fed by the metal roller 31A (driving side) by a pressing mechanism 33A (33). When the sponge roller 31B approaches or separates from the envelope F being fed by the metal roller 31A, the pressing mechanism 33A sets a nip timing of the metal roller 31A and the sponge roller 31B according to an attribution of envelope.

More specifically, the sponge roller 31B is rotatably attached to one end of an inverted L-shaped arm 35 capable of rotating around an axis 34. A rod 36*a* of a solenoid 36 is linked to the other end of the inverted L-shaped arm 35 using a nut 38 and a first washer 40*a*. A compression spring 37 is compressed between the solenoid 36 and a second washer 40*a*. A symbol "S" indicates a stopper for the inverted L-shaped arm 35.

In a state where a back sheet Fb of an envelope F abuts on the metal roller 31A and a top sheet Fa of the envelope F abuts on the sponge roller 31B (see FIG. 7A), when the control portion 80 applies a current to the solenoid 36, the inverted L-shaped arm 35 rotates around the axis 34 in an anticlockwise direction. In this state, the sponge roller 31B presses a side of a rear end portion Fe of the envelope F by certain pressing while the inverted L-shaped arm 35 acts against biasing force of the compression spring 37, within a range of a first distance L1 which is a range for correcting warpage from the rear end portion Fe toward a front end portion Fc of the envelope F. This corrects bending-upward occurring at the side of the rear end portion Fe of the envelope F by warping the rear end portion Fe in a direction opposite to a direction in which the rear end portion Fe warps before the correction, while the envelope F is sandwiched between the metal roller 31A and the sponge roller 31B and carried. Thereby, the rear end portion Fe of the envelope F becomes flat.

As described in "BACKGROUND OF THE INVENTION", since a degree of warpage occurring at a side of a rear end portion Fe of an envelope F depends on an attribution of the envelope F (length of envelope in a longitudinal direction, width of envelope perpendicular to the longitudinal direction, thickness of envelope and material), the range of the first distance L1 within which the sponge roller 31B is pressed is set according to the attribution of the envelope. For example, the degree of warpage is proportional to the one power of a length of envelope in a longitudinal direction, a width of envelope perpendicular to the longitudinal direction, a material or the like. Also, in view of bending strength, the degree of warpage is proportional to the cube of a thickness of envelope. In consideration of these points, the range of the first distance L1 which is a range for correcting warpage may be set.

After the envelope F passes the pair of correction rollers 31 by the first distance L1, when the control portion 80 stops to apply a current to the solenoid 36, the inverted L-shaped arm 35 rotates around the axis 34 in clockwise direction by biasing force of the compression spring 37. In this state, the sponge roller 31B separates from the envelope F and the pressing force becomes zero (FIG. 7B). Thereby, wrinkles do not occur within a range of a second distance L2 which follows the first distance L1 and extends to the front portion Fc of the envelope F.

Therefore, when the pressing mechanism 33A is operated, the warpage occurring at the side of the rear end portion Fe of the envelope F is corrected according to an attribution of envelope F, and wrinkles does not occur at the side of the front end portion Fc of the envelope F.

As shown in FIGS. 8A and 8B, in the second mode, the sponge roller 31B (driven side) continue to abut on an envelope F being fed by the metal roller 31A (driving side) by a pressing mechanism 33B (33). A pressing mechanism 33B is mounted to change pressing force acting from the sponge roller 313 toward the metal roller 31A according to an attribution of envelope.

More specifically, the sponge roller 31B is rotatably attached to one end of the inverted L-shaped arm 35 capable of rotating around the axis 34. One end of a layered piezo element 39 is fixed to the other end of the inverted L-shaped arm 35. The other end of the layered piezo element 39 is fixed.

In a state where a back sheet Fb of an envelope F abuts on the metal roller 31A and a top sheet Fa of the envelope F abuts on the sponge roller 31B (see FIG. 8A), when the control portion 80 applies a relatively large voltage to the layered piezo element 39, relatively large pressing force is applied to the sponge roller 31B via the inverted L-shaped arm 35. This presses the sponge roller 31B by relatively large pressing force. By pressing the sponge roller 31B by the relatively large pressing force within a range of a first distance L1 which is a range for correcting warpage from the rear end portion Fe toward a front end portion Fc of the envelope F, bending-upward occurring at the side of the rear end portion Fe of the envelope F is corrected by warping the rear end portion Fe in a direction opposite to a direction in which the rear end portion Fe warps before the correction, while the envelope F is sandwiched between the metal roller 31A and the sponge roller 31B and carried. Thereby, the rear end portion Fe of the envelope F becomes flat.

As well as the first mode, the range of the first distance L1 for pressing the sponge roller 31B is determined based on an attribution of envelop.

After the envelope F passes the pair of correction rollers 31 by the first distance L1, when the control portion 80 applies a relatively small voltage to the layered piezo element 39, relatively small pressing force is applied to the sponge roller 31B via the inverted L-shaped arm 35 (see FIG. 8B). Thereby, wrinkles does not occur at the front end portion Fc of the envelope F because the relatively small pressing force is applied within a range of a second distance L2 which follows the first distance L1 and extends to the front portion Fc of the envelope F.

Therefore, when the pressing mechanism 33B is operated, the warpage occurring at the side of the rear end portion Fe of the envelope F is corrected according to an attribution of envelope F, and wrinkles does not occur at the side of the front end portion Fc of the envelope F.

As described above, according to the envelope warpage correcting device 1A, when the pair of correction rollers 31 and either the pressing mechanism 33A or 33B correct warpage occurring at a side of a rear end portion Fe of an envelope F, the control portion 80 instructs the envelope warpage correcting portion 30 to control pressing force of the pair of correction rollers 31 to the envelope F at certain timing according to an attribution of envelope F. This allows the warpage occurring at the side of the rear end portion Fe of the envelope F to be corrected based on the attribution of envelope F, and prevents wrinkles from occurring at a side of a front end portion Fc of the envelope Fat a time of correcting warpage occurring at the side of the rear end portion Fe of the envelope F.

At this time, the envelope warpage correcting portion 30 instructs the pressing mechanism 33A or 33B to change certain timing at which pressing force of the sponge roller 31B to the envelope F is changed, so as to decrease the pressing force of the pair of correction rollers 31 to the envelope F according to the attribution of envelope F. This subjects the envelope F to correction processing until the side of the front end portion Fc of the envelope F while certainly correcting the warpage occurring at the side of the rear end portion Fe of the envelope F. This also prevents wrinkles from occurring at the side of the front end portion Fc of the envelope F.

(Second Exemplary Embodiment)

Figure 9:
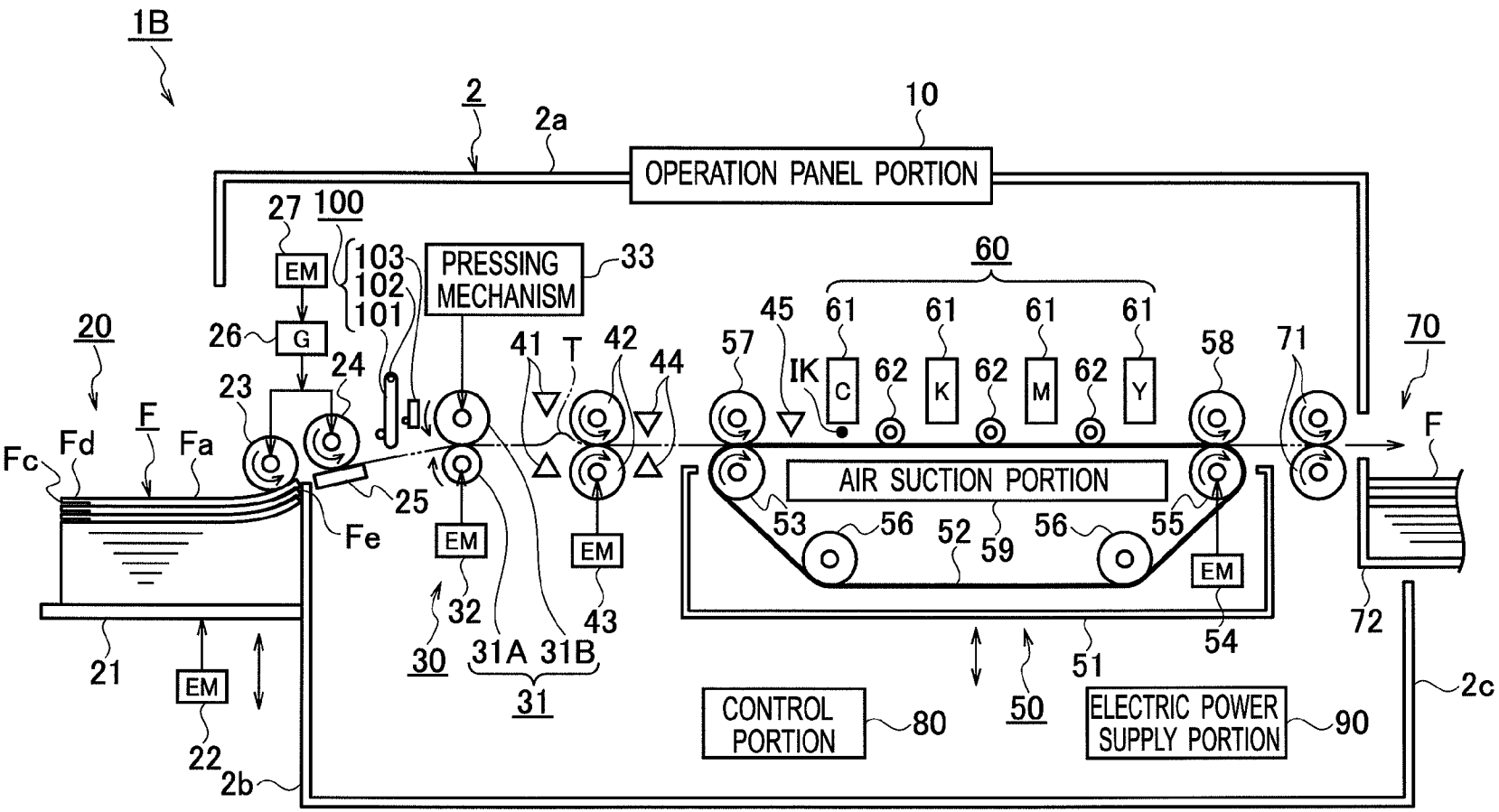
FIG. 9 is a whole configuration diagram that illustrates an envelope warpage correcting device according to a second exemplary embodiment of the present invention.

An envelope warpage correcting device 1B shown in FIG. 9 is the same structure as the envelope warpage correcting device 1A shown in FIG. 4, except for a part of the envelope warpage correcting device 1A. With respect to each element of the envelope warpage correcting device 1B having the same structure as each element of the envelope warpage correcting device 1A, the both elements have the same symbol. With respect to each element of the envelope warpage correcting device 1B having a different structure from each element of the envelope warpage correcting device 1A, the different element of the envelope warpage correcting device 1B has a new symbol. Each element of the envelope warpage correcting device 1A will be described as necessary.

As shown in FIG. 9, the envelope warpage correcting device 1B differs from the envelope warpage correcting device 1A in that an envelope wrinkle detecting portion 100 is arranged between the sheet feeding portion 20 and the envelope warpage correcting portion 30.

As illustrated in FIG. 6B, when warpage occurring at the side of the rear end portion Fe of the envelope F is corrected using the pair of correction rollers 31 mounted in the envelope warpage correcting portion 30, there is a possibility that wrinkles occur at the side of the front end portion Fc of the envelope F according to the attribute of envelope F. The envelope wrinkle detecting portion 100 has a function for detecting an occurrence of wrinkles based on the heights of wrinkles and instructing the control portion 80 to control the pair of correction rollers 31 mounted in the envelope warpage correcting portion 30 according to the occurrence of wrinkles.

Figure 10:
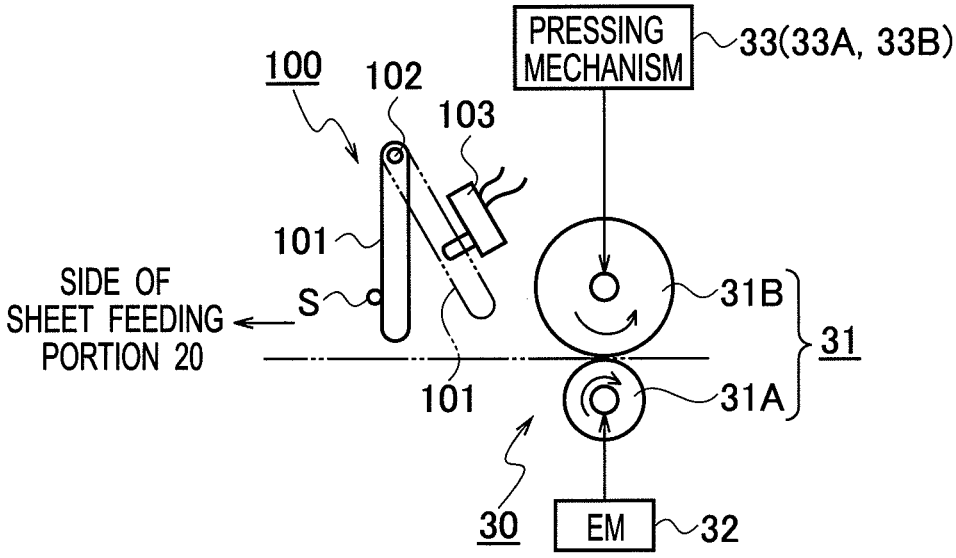
FIG. 10 is a diagram that illustrates an envelope wrinkle detector shown in FIG. 9.

A concrete structure of the envelope wrinkle detecting portion 100 will be described. As shown in FIG. 10, a lever 101 is mounted above the carrier line between the sheet feeding portion 20 and the envelope warpage correcting portion 30 so as to rotate around an axis 102. At an initial state, the lever 101 droops under its own weight toward the carrier line, as indicated by a solid line in FIG. 10. At an operating time, the lever 101 rotates around the axis 102 in an anticlockwise direction to abut on a switch 103.

In the envelope warpage correcting device 1B, when warpage occurring at a side of a rear end portion Fe of an envelope F fed by the sheet feeding portion 20 is corrected by the pair of correction rollers 31 in the envelope warpage correcting portion 30, the control portion 80 changes pressing force of the sponge roller 31B to the metal roller 31A according to a detection result of the envelope wrinkle detecting portion 100. Thereby, the range for correcting warpage from the rear end portion Fe toward the front end portion Fc of the envelope F described in the first exemplary embodiment is a range between the rear end portion Fe of the envelope F and a portion where wrinkles are firstly detected.

Figure 11:
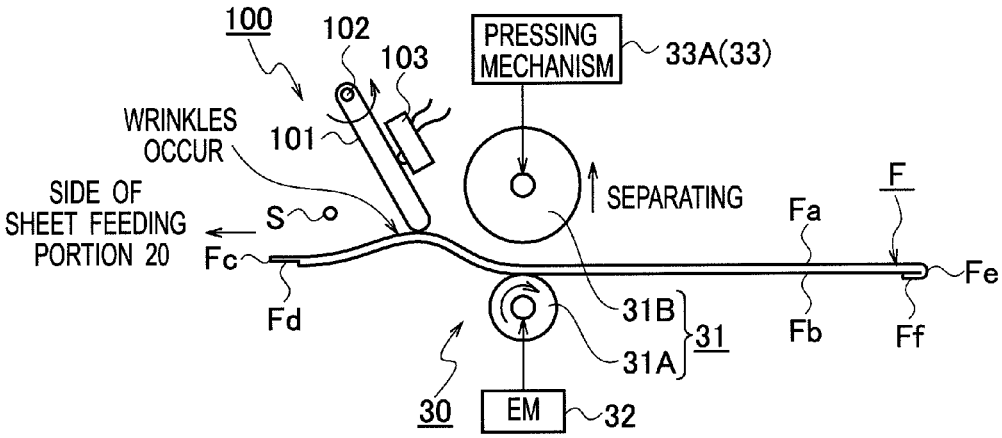
FIG. 11 is a diagram that illustrates an operation of the envelope wrinkle detecting portion shown in FIG. 9 in a first mode.
Figure 12:
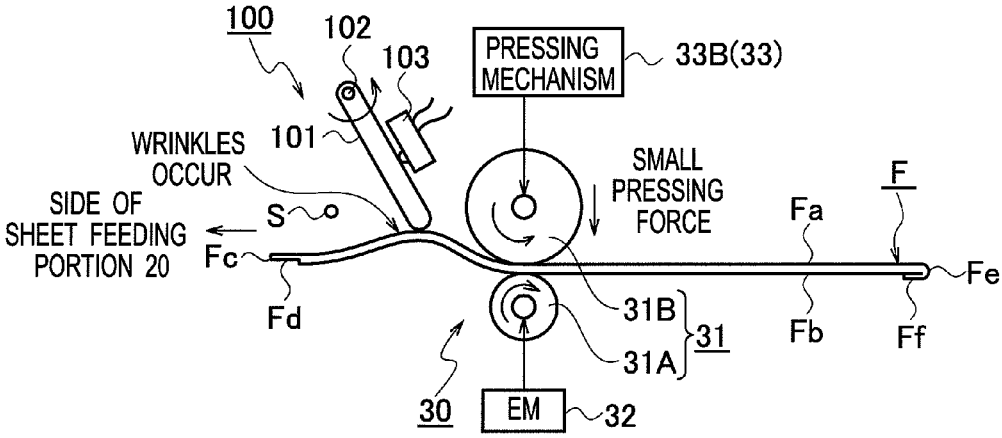
FIG. 12 is a diagram that illustrates an operation of the envelope wrinkle detector shown in FIG. 9 in a second mode.

When the envelope wrinkle detecting portion 100 is operated, either a first mode shown in FIG. 11 or a second mode shown in FIG. 12 is applied to the pressing mechanism 33.

As shown in FIG. 11, in the first mode, during a process in which the pair of correction rollers 31 in the envelope warpage correcting portion 30 warps a side of a rear end portion Fe of an envelope F in a direction opposite to a direction in which the rear end portion Fe warps before the correction, when wrinkles occur at a side of a front end portion Fc of the envelope F, the lever 101 in the envelope wrinkle detecting portion 100 is rotated around the axis 102 in the anticlockwise direction due to a height of wrinkles occurring. If the occurrence of wrinkles is detected by the switch 103, the control portion 80 instructs the pressing mechanism 33A in the envelope warpage correcting portion 30 to cause the sponge roller 31B to separate from the envelope F. Due to this, pressing force of the sponge roller 31B to the metal roller 31A is zero, which reduces an occurrence of wrinkles at the side of the front end portion Fc of the envelope F.

As shown in FIG. 12, in the second mode, during a process in which the pair of correction rollers 31 in the envelope warpage correcting portion 30 warps a side of a rear end portion Fe of an envelope F in a direction opposite to a direction in which the rear end portion Fe warps before the correction, when wrinkles occur at a side of a front end portion Fc of the envelope F, the lever 101 in the envelope wrinkle detecting portion 100 is rotated around the axis 102 in the anticlockwise direction due to a height of wrinkles occurring. If the occurrence of wrinkles is detected by the switch 103, the control portion 80 instructs the pressing mechanism 33B in the envelope warpage correcting portion 30 to reduce pressing force of the sponge roller 31B to the metal roller 31A. This reduces an occurrence of wrinkles at the side of the front end portion Fc of the envelope F.

As described above, according to the envelope warpage correcting device 1B, the envelope wrinkle detecting portion 100 is mounted between the sheet feeding portion 20 and the envelope warpage correcting portion 30. The envelope wrinkle detecting portion 100 detects wrinkles occurring at a side of a front end portion Fc of an envelope F during a process in which warpage occurring at a side of a rear end portion Fe of the envelope F is corrected by the envelope warpage correcting portion 30. If the envelope wrinkle detecting portion 100 detects wrinkles occurring at the side of the front end portion Fc of the envelope F, the control portion 80 instructs the envelope warpage correcting portion 30 to control pressing force of the pair of correction rollers 31 to the envelope F. This reduces an occurrence of wrinkles at the side of the front end portion Fc of the envelope F.

What is claimed is:

1. An envelope warpage correcting device comprising:

a sheet feeding portion that feeds envelopes one-by-one using a sheet feed roller, the sheet feed roller configured to retrieve an envelope from a stack of envelopes that are stacked on a sheet feed table, wherein the envelopes comprise a first end portion that is opposite a flap portion, and the envelopes are arranged in a sheet feed direction, with the first end portion nearest the sheet feed roller;

a correcting portion that is arranged in a downstream direction with respect to the sheet feeding portion and configured to correct warpage occurring at a side of the first end portion of the envelope fed by the sheet feeding portion, wherein the correcting portion includes a correction roller and a pressing mechanism configured to apply a first pressure to an envelope via the correction roller; and a control portion that is configured to control the correcting portion to apply the first pressure to the envelope, and reduce the pressing force to the envelope to which the first pressure has been applied resulting in a second pressure that is less than the first pressure at a certain timing according to an attribution of the envelope, wherein the control portion controls the pressing mechanism at the certain timing to reduce the pressing force of the correction roller to the envelope resulting in the second pressure according to the attribution of the envelope.

2. An envelope warpage correcting device comprising:

a sheet feeding portion that feeds envelopes one-by-one using a sheet feed roller, the sheet feed roller configured to retrieve an envelope from a stack of envelopes that are stacked on a sheet feed table, wherein each of the envelopes comprises a first end portion that is opposite a flap portion formed in a second end portion, and each of the envelopes is arranged in a sheet feed direction, with the first end portion nearest the sheet feed roller;

a correcting portion that is arranged in a positioned downstream direction with respect to the sheet feeding portion and configured to correct warpage occurring at a side of the first end portion of the envelope fed by the sheet feeding portion; and a control portion that controls processing for correcting the warpage occurring at the side of the first end portion of the envelope by the correcting portion at a certain timing according to an attribution of the envelope, wherein the correcting portion includes a correction roller and a pressing mechanism, and wherein the control portion controls the pressing mechanism such that the correction roller approaches the envelope to press the side of the first end portion of the envelope in a first direction opposite to a second direction in which the envelope warps before the correction, and separates from the envelope at the certain timing.

3. An envelope correcting device comprising:

a sheet feeding portion that feeds envelopes one-by-one using a sheet feed roller, the sheet feed roller configured to retrieve an envelope from a stack of envelopes that are stacked on a sheet feed table, wherein each of the envelopes comprises a first end portion that is opposite a flap portion formed in a second end portion, and each of the envelopes is arranged in a sheet feed direction, with the first end portion nearest the sheet feed roller;

a correcting portion that is arranged downstream direction with respect to the sheet feeding portion and configured to corrects correct warpage occurring at a side of the first end portion of the envelope fed by the sheet feeding portion; and a control portion that controls processing for correcting the warpage occurring at the side of the first end portion of the envelope by the correcting portion at a certain timing according to an attribution of the envelope, wherein the correcting portion includes a correction roller and a pressing mechanism, and wherein the control portion controls the pressing mechanism such that the correction roller presses the side of the first end portion of the envelope by a relatively large pressing force in a first direction opposite to a second direction in which the envelope warps before the correction, the correction roller then presses the side of the second end portion by a relatively small pressing force in the first direction at the certain timing.

* * * * *